US008073361B2

(12) United States Patent
Oshige

(10) Patent No.: US 8,073,361 B2
(45) Date of Patent: Dec. 6, 2011

(54) PRESET CASE, DEVELOPMENT APPARATUS, PROCESS CARTRIDGE, AND IMAGE FORMING APPARATUS

(75) Inventor: Wakako Oshige, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 458 days.

(21) Appl. No.: 12/379,568

(22) Filed: Feb. 25, 2009

(65) Prior Publication Data

US 2009/0214256 A1 Aug. 27, 2009

(30) Foreign Application Priority Data

Feb. 25, 2008 (JP) ..... 2008-042849
Oct. 9, 2008 (JP) ..... 2008-262457

(51) Int. Cl.
*G03G 15/08* (2006.01)
*G03G 15/10* (2006.01)

(52) U.S. Cl. ..... 399/120; 399/62; 399/106

(58) Field of Classification Search ..... 399/61, 399/62, 63, 106, 119, 120
See application file for complete search history.

(56) References Cited

U.S. PATENT DOCUMENTS 6,760,556 B2 * 7/2004 De Kesel et al. ..... 399/106
7,024,133 B2 4/2006 Nagashima et al.
7,136,610 B2 11/2006 Arai et al.
7,305,203 B2 12/2007 Sampe et al.
7,343,132 B2 3/2008 Kimura et al.
7,433,615 B2 10/2008 Murakami et al.
2002/0021915 A1 * 2/2002 Nagashima ..... 399/106
2006/0008296 A1 1/2006 Sampe et al.
2006/0018680 A1 1/2006 Hosokawa et al.
2006/0115292 A1 6/2006 Sampe et al.
2007/0248368 A1 10/2007 Kato et al.
2008/0069580 A1 3/2008 Oshige et al.
2009/0116861 A1 5/2009 Oshige et al.

FOREIGN PATENT DOCUMENTS

JP 2003-307918 10/2003
JP 2009-047714 3/2009

* cited by examiner

*Primary Examiner* — David Gray
*Assistant Examiner* — Joseph Wong
(74) *Attorney, Agent, or Firm* — Harness, Dickey & Pierce, P.L.C.

(57) ABSTRACT

A developing apparatus has: a developer container including a developer transportation unit that transports, while mixing, a developer containing a toner and a carrier along an axis of rotation by a rotatable mixing transportation member; and a cover member provided in part of the developer transportation unit so as to cover an upper portion of the mixing transportation member. A preset case disposed on top of the developer transportation unit has: a developer feed port provided on that bottom surface of the preset case which lies on a side of the developer container; and a sealing member that seals a developer feed port, the sealing member being mounted so as to be removable, when putting the preset case to use, longitudinally of the mixing transportation member. The developer feed port is provided except for a position that lies opposite to the cover member.

12 Claims, 9 Drawing Sheets

PRESET CASE, DEVELOPMENT APPARATUS, PROCESS CARTRIDGE, AND IMAGE FORMING APPARATUS

CROSS REFERENCE TO RELATED APPLICATIONS

The present application is based on and claims priority from Japanese Application Number 2008-042849, filed on Feb. 25, 2008 and Japanese Application Number 2008-262457, filed on Oct. 9, 2008, the disclosure of which is hereby incorporated by reference herein in its entirety.

BACKGROUND

1. Technical Field

The present invention relates to a preset case, a development apparatus, a process cartridge and an image forming apparatus which are used in a plotter and the like of a copying machine, a fax machine, a printer, an electrophotographic recording apparatus using electrophtographs.

2. Related Art

In a xerographic photocopier, for example, there has extensively been used a development apparatus which visualizes (develops) an electrostatic latent image on a surface of a photoreceptor by employing a two-component developer consisting essentially of a carrier and a toner. In this kind of development apparatus while the toner is consumed as a result of developing operation, the carrier is not consumed but will stay in the development apparatus. Therefore, the content of toner (toner concentration) of the developer varies and the image density will consequently vary.

As a control method for keeping constant the concentration of the toner in a developer container in order to prevent the image density from varying, there is known a method in which the toner concentration is detected and, based on this detected toner concentration, the amount of toner to be added or supplied is determined. However, if the toner concentration is wrongly detected, the toner concentration cannot be controlled at a constant value. As a consequence, a stable image density cannot be obtained and, in addition, there will occur deficiencies and image deterioration due to toner scattering by excessive feed of toner, as well as carrier adhesion due to too small an amount of toner feed, and the like.

In order to control the content of toner in the developer, there is generally provided a toner concentration detection sensor to detect the toner concentration. With the two-component developer, a magnetic permeability sensor has been used as the toner concentration detection sensor. Magnetic permeability attributable to carrier which is a magnetic body is detected and the ratio of toner to the carrier is detected based on the detected magnetic permeability. Control is made as to whether the toner shall be supplied or not based on the increase or decrease of this toner concentration so that the toner concentration in the developer container can be kept constant.

It is to be noted, however, that the magnetic permeability detected by the above-described magnetic permeability sensor is determined by the amount of carrier contained in a certain amount of volume. It follows that, even if the mixing ratio of the toner and the carrier is constant, the magnetic permeability varies with the change in the density of the developer.

Therefore, if the distances among the developer particles vary with the variation of the amount of electrostatic charges of toner, the toner concentration will be different from magnetic permeability sensor to magnetic permeability sensor even with the same toner concentration.

In case the development apparatus continuously operates under conditions of small toner balance such, for example, as continuous output in a small image area ratio, the same particles of toner are likely to be mixed or agitated many times in the developer tank or reservoir so as to be frictionally electrified. As a result, the amount of electrification (electrostatic charges) increases, and the repulsive forces among the developer particles get stronger, resulting in a decrease in the apparent bulk density. Accordingly, the magnetic permeability senor is likely to detect a higher toner concentration than the actual toner concentration.

Aside from the above example, the apparent bulk density of the toner varies with the difference in environmental conditions, the act of leaving as it is for an extended period of time, and the like. Therefore, the magnetic permeability sensor may be said to have a tendency of wrongly detecting the toner concentration depending on the environmental conditions or the manner in which it is used.

In view of the above, in order to accurately detect the toner concentration, it is preferable that the development apparatus is constructed such that the bulk change of the developer is minimized on the detecting surface of the toner concentration detection sensor (magnetic permeability sensor). In order to minimize the bulk change, it is effective to employ a construction in which a certain degree of pressure is applied to the developer (pressurizing construction). As a result, minimizing the bulk change is conceived to be attainable by arranging to make the developer to be pressurized on the surface of the sensor detection.

For example, JP-A-2003-307918 discloses an apparatus for pressurizing the toner by making the cross-sectional area of a toner passage at a position in which the toner concentration detection unit is disposed and the surrounding region smaller than the cross-sectional area of the remaining flow passages.

However, the art as disclosed in JP-A-2003-307918 is subject to the following problem, i.e., in case the flowability of the developer becomes poor due to deterioration and/or environmental changes, the same toner is likely to stay between a screw vane and the detection surface of the toner detection unit, resulting in incapability of detecting the correct toner concentration. In other words, in order to correctly detect the toner concentration, the developer must be sufficiently mixed around the detecting surface of the toner concentration detecting unit and also the developer must be sufficiently replaced near the detecting surface.

In order to clean the detecting surface of the toner concentration detecting unit, i.e., in order to replace the toner on the detecting surface, there has conventionally been used a fin, Mylar, and the like which are disposed horizontally in the longitudinal direction of the screw axis. However, the problem still arises in that, due to the above-described bulk changes of the toner, the toner concentration cannot accurately be measured. In other words, in order to detect the toner concentration without bulk changes, an arrangement must be employed such that the bulk changes are restrained or kept under control near the detection surface of the toner concentration detection sensor.

SUMMARY

Therefore, the invention has an advantage, among others, of providing a development apparatus that is capable of keeping under control the variations in toner concentration detection due to bulk changes in toner. In other words, in the development apparatus, the developer can be pressurized near detection surface so as to restrict the lowering of detection accuracy due to retention of the developer on the surface of the toner concentration detection by the sensor. That is, the development apparatus according to the invention is capable of sufficiently replacing the toner on the detection surface.

According to one aspect of the invention, there is provided a preset case for keeping therein unused initial fill of developer, the preset case being disposed on top of a developer transportation unit of a developing apparatus. The developing apparatus comprises: a developer container having the developer transportation unit that transports, while mixing, a developer containing a toner and a carrier along an axis of rotation by a rotatable mixing transportation member; and a cover member provided, out of an entire region as seen in a direction of transportation of the developer, in part of the developer transportation unit so as to cover an upper portion of the mixing transportation member. The preset case comprises: a developer feed port provided on that bottom surface of the preset case which lies on a side of the developer container; and a sealing member that seals the developer feed port, the sealing member being mounted so as to be removable, when putting the preset case to use, in a longitudinal direction of the mixing transportation member. The developer feed port is provided except for a position that lies opposite to the cover member disposed in the developer transportation unit.

According to another aspect of the invention, there is provided a preset case for keeping therein unused initial fill of developer, the preset case being disposed on top of a developing apparatus. The developing apparatus comprises: a developer container and a hold-down wall. The developer container has: a developer transportation unit that transports, while mixing, a developer containing a toner and a carrier along an axis of rotation by a rotatable mixing transportation member; and a toner concentration detection unit that detects a concentration of the toner to be transported inside the developer transportation unit. The hold-down wall holds down the toner in a gravitationally downward direction by coming into contact with the toner from a gravitationally upper side, the toner moving upward from the gravitationally lower side as a result of rotation of the mixing transportation member. The hold-down wall is disposed in a region, out of an entire region in the direction of developer transportation at the developer transportation unit, in which a bottom wall of the developer transportation unit lies opposite to the gravitationally lower side of the mixing transportation member and in which side walls of the developer transportation unit lie opposite to each other on both sides that cross at right angles to an axis of rotation of the mixing transportation member. The preset case comprises: a developer feed port provided on that bottom surface of the preset case which lies on a side of the developer container; and a sealing member that seals the developer feed port. The sealing member is mounted so as to be removable, when putting the preset case to use, in a longitudinal direction of the mixing transportation member. The developer feed port is provided except for a position that lies opposite to the cover member disposed in the developer transportation unit.

According to the above-described arrangement, it is possible to detect the concentration of the toner which is less influenced by the bulk changes of the developer, and also to increase the sensitivity of toner concentration detection. As a result of this kind of effects, more accurate toner concentration detection can be performed and, based on the detected toner concentration, the control over the toner concentration can be performed, thereby maintaining a higher image quality and high stability.

According to still another aspect of the invention, there is provided a development apparatus which comprises: a developer container having a developer transportation unit that transports, while mixing, a developer containing a toner and a carrier along an axis of rotation by a rotatable mixing transportation member; a cover member provided, out of an entire region as seen in a direction of transportation of the developer, in part of the developer transportation unit so as to cover an upper portion of the mixing transportation member; and a preset case that keeps therein unused initial fill of developer, the preset case being disposed on top of the developer transportation unit. The preset case comprises: a developer feed port provided at a bottom surface thereof on a side of the developer container; a sealing member for sealing the developer feed port. The sealing member is mounted so as to be removable, when putting the preset case to use, in a longitudinal direction of the mixing transportation member. The developer feed port is provided except for a position that lies opposite to the cover member disposed in the developer transportation unit.

According to the above-described arrangement, the bottom surface of the preset case constitutes the developer feed port in the preset case. However, the developer feed port is provided at a position except for a position which lies opposite to the cover member disposed in the developer transportation unit. Therefore, the developer is prevented from getting accumulated on the cover member, whereby the developer inside the preset case can be fed into the developer container.

DETAILED DESCRIPTION OF THE PREFERRED EMBODIMENTS

Figure 1:
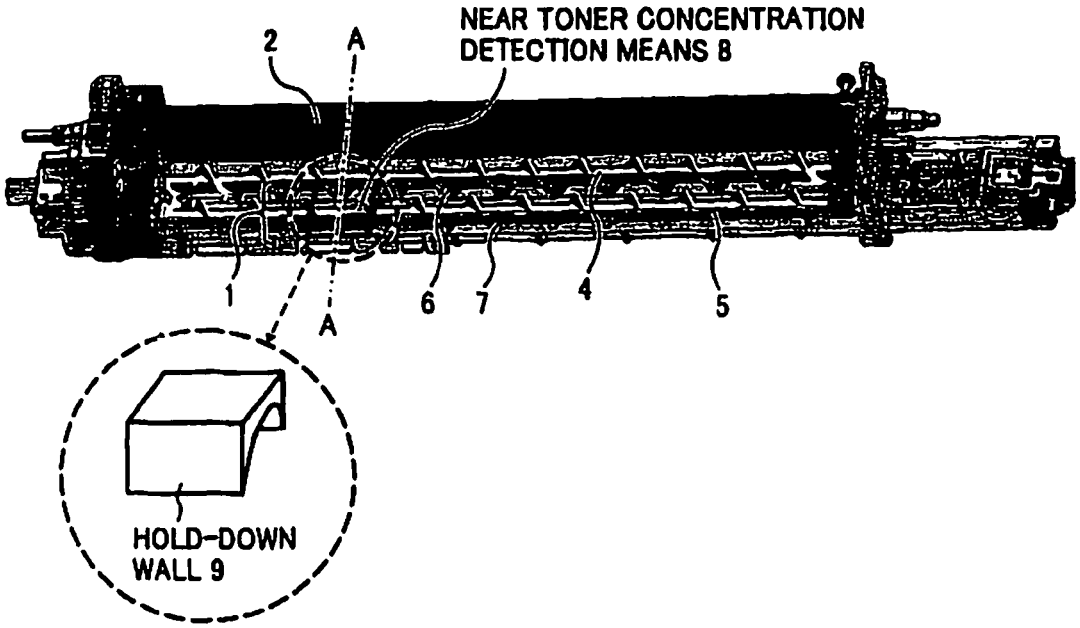
FIG. 1 is a perspective view of an example of a preset case and a development apparatus according to the invention.

With reference to the accompanied drawings, detailed description will now be made of the embodiments of the invention.

FIGS. 1 through 4 illustrate an example of a preset case 11 of the invention as well as a development apparatus of the invention in which the preset case 11 is disposed therein. The development apparatus is made up of a developer container 1 (a developer tank) for keeping therein developer 10; a developer roll 2 as a developer carrier; a developer roll housing 3 for housing therein the developer roll 2; a first developer-mixing region 4 which lies close to the developer roll housing 3 and is elongated along an axial direction of the developer roll 2; a second developer-mixing region 5; a first transportation screw 6; and a second transportation screw 7. The second developer-mixing region 5 is disposed adjacent to the first developer-mixing region 4 and is partitioned from the first developer-mixing region 4 by a partition wall 16 except for axial both end portions thereof. The second developer-mixing region 5 is in communication with the first developer-mixing region 4 at axial both ends thereof, and is formed by the partition wall 16 and that outer wall of the developer container 1 which is elongated along the partition wall 16. The first transportation screw 6 as a mixing transportation member is disposed in the first developer-mixing region 4 and agitates a two-component developer while transporting it in the axial direction of the developer roll 2. The second transportation screw 7 as a mixing transportation member is disposed in the second developer-mixing region 5 and agitates the two-component developer while transporting it in a direction opposite to the direction of the first transportation screw 6. A fin for cleaning the detection surface of the toner concentration detection sensor is disposed on the screw shaft at a position, as seen in the longitudinal direction of the second transportation screw 7, corresponding to the position of toner concentration detection sensor (toner concentration detection means) 8.

Further, above the developer container 1 at a position corresponding to the toner concentration detection sensor 8, there is provided a cover member. In this embodiment, the upper inner wall (hereinafter referred to as a hold-down wall 9) is formed substantially into the shape of an alphabetical letter R having a radius of curvature slightly larger than the radius of the second transportation screw 7 so that the hold-down wall 9 coming into contact with the developer 10 which is apt to be moved up by the fin from the gravitationally lower side produces an effect of holding it down (pressurizing effect).

Figure 2:
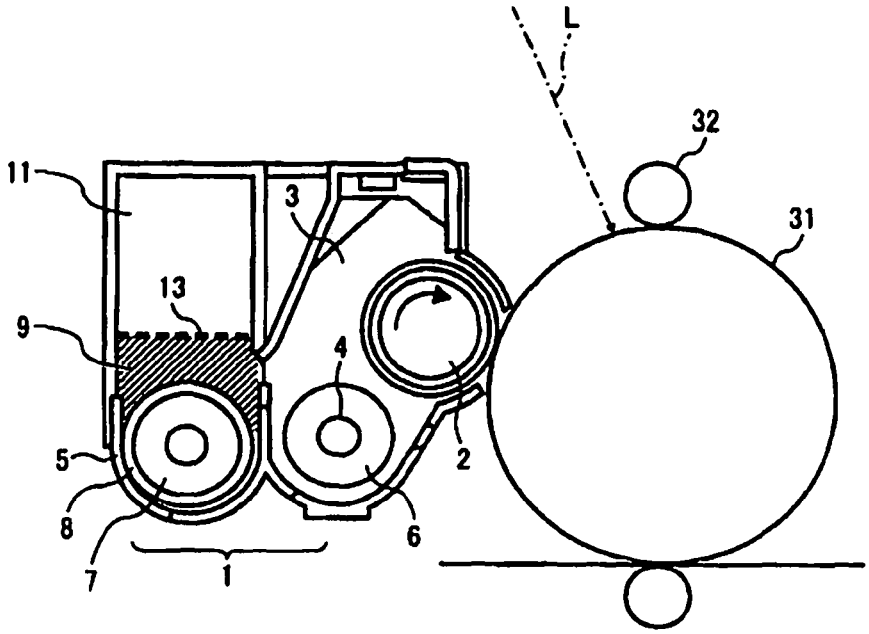
FIG. 2 is a sectional view taken along the line A-A in FIG. 1.
Figure 3:
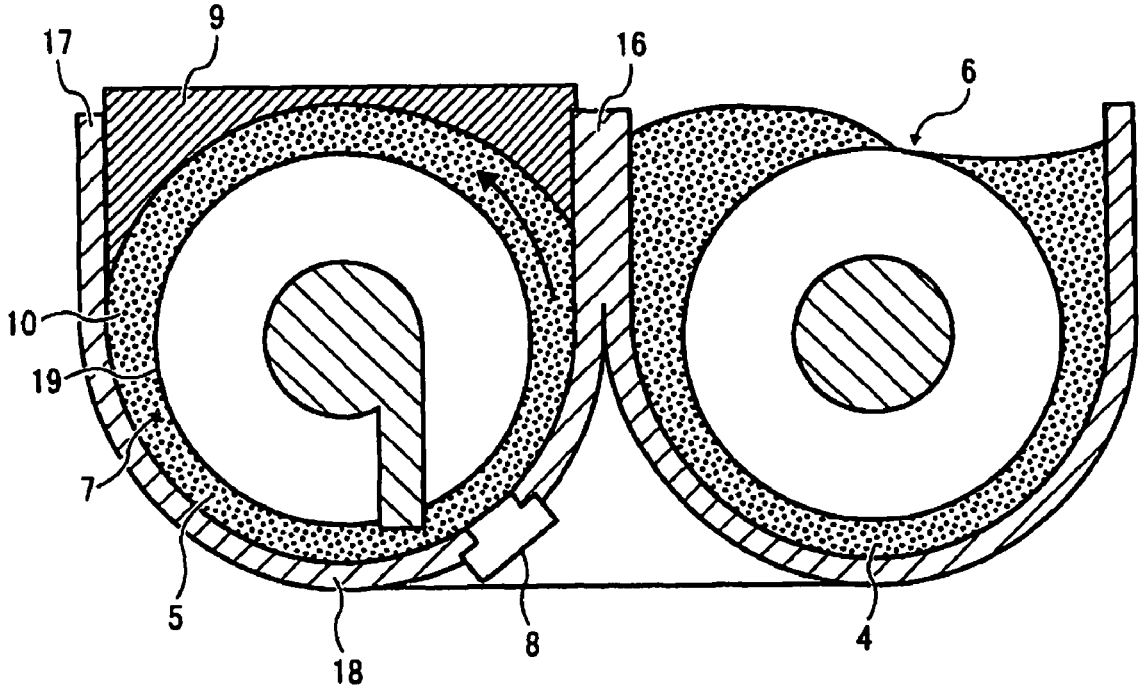
FIG. 3 is a cross-sectional side view showing the development apparatus.

FIG. 3 is an enlarged view of the developer transportation unit (the first developer-mixing region 4 and the second developer-mixing region 5) as shown in FIG. 2. As shown in FIG. 3, the hold-down wall 9 is disposed in at least the following regions out of the entire region of the second developer-mixing region 5. In other words, the region in question is where the bottom wall 18 of the second developer-mixing region 5 is caused to oppose the second transportation screw 7 on the lower side of the direction of gravitation, and where the side walls (left side plate 17, the partition wall 16) of the second developer-mixing region 5 are caused to lie opposite to both sides crossing at right angles to the axis of rotation of the second transportation screw 7, and where the concentration of the toner in the developer 10 under transportation is being detected by the toner concentration detection sensor 8.

As shown in FIG. 3, the hold-down wall 9 is elongated between the left side wall 17 and the partition wall 16 of the second developer-mixing region 5 and covers the second developer-mixing region 5 from the upper side. The wall opposite to the hold-down wall 9 relative to the second transportation screw 7 has formed therein a curvature (bottom wall 18) which is curved along the curvature of the screw vane 19. The hold-down wall 9 according to the above described arrangement comes into contact, from the upper vertical side, with the developer 10 that moves from the gravitationally lower side toward the upper side as a result of rotation of the of the second transportation screw 7, thereby holding down the developer vertically downward.

As a result of this holding down, the developer 10 within the screw space of the second transporting screw 7 is pushed out, while being compressed, in the radially outward direction of the second transporting screw 7. Then, part of the developer 10 held within the screw space of the second transporting screw 7 is pushed out into the clearance between the outer edge of the screw vane 19 and the bottom wall 18. As a result, the pushed-out developer 10 is strongly urged toward the detecting surface of the developer 10 that is positioned near the detecting surface of the toner concentration detection sensor 8. The error in the detection of toner concentration which is attributable to the varying bulk of the toner can thus be reduced as compared with the conventional method.

Next, with reference to FIG. 4, a description will be made of the construction of the preset case 11. The preset case 11 is a case that is used to contain therein unused initial fill or feed of developer and that is attached to an upper part of the developer container 1. The preset case 11 is constituted by a seal at the bottom (a sealing member 13, also referred to as a preset seal 13). By removing this seal, the developer is arranged to be fed or supplied into the lower developer container 1 through gravity.

In this embodiment, it is so arranged that the preset case 11 is set in position above the second developer-mixing region 5. In order to enable to supply the whole of the second developer-mixing region 5 with the developer 10, the preset case 11 has a length which is substantially equal to the second developer-mixing region 5 as seen in the longitudinal-direction. Out of the bottom surface of the preset case 11, the portion except for the position corresponding to the hold-down wall 9 and the bottom surface corresponding to the hold-down wall 9, as seen in the longitudinal direction, when being set in position in the developer container 1, constitutes a developer feed port 12. This developer feed port 12 is sealed with the manually removable sealing member 13. In the preset case 11, there is provided a region 20 in which the developer 10 is not supplied. Such a region lies in a part except for the developer feed port 12.

As described hereinabove, the preset case 11 of the invention is so arranged that the bottom surface thereof constitutes the developer feed port 12. However, since the developer feed port 12 is formed in a portion except for the bottom surface corresponding to the hold-down wall 9, the developer 10 is prevented from getting accumulated on the hold-down wall 9. It is therefore possible to feed the developer 10 inside the preset case 11 to the developer container 1.

The development apparatus employing the two-component developer consisting essentially of a magnetic carrier and a toner and the process cartridge including the above-described development apparatus are respectively sealed into separate keeping spaces in a state in which the magnetic carrier and the toner are separated from each other so that the developer housed in the development apparatus does not scatter on the way of delivery out of manufacturing works and during transportation. Each of the keeping spaces is sealed with a sealing member, which is to be manually removed from outside. As a result, the magnetic carrier and the toner in each of the spaces are allowed to be fed (or to flow) into the required portions within the development apparatus and get mixed together. In case the development apparatus is assembled into an image forming apparatus such as an electrophotographic copying machine, a printer, a facsimile, and the like, there is performed the work of removing the seal right before assembling it into a predetermined position of the unit main body of the development apparatus. Through this work, the magnetic carrier and the toner are caused to be fed into the predetermined portions of the development apparatus.

Figure 4A:
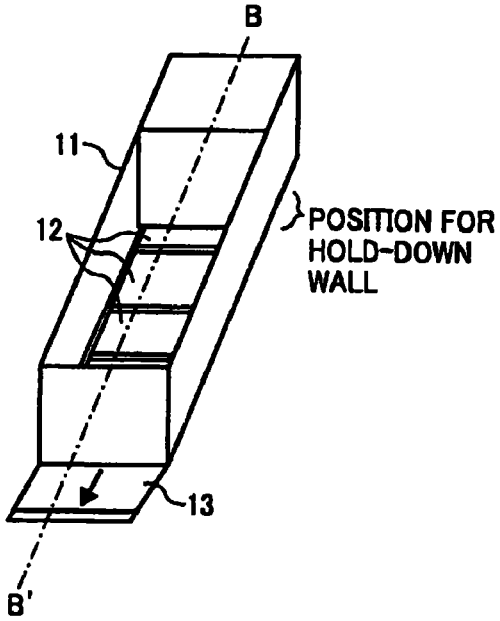
FIG. 4A is a perspective view of a preset case and FIG. 4B is a cross-sectional view taken along the line B-B' in FIG. 4A.
Figure 4B:
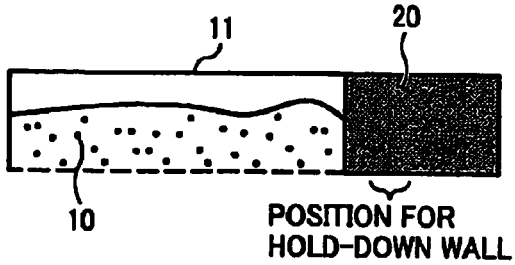

The construction as shown in FIG. 4A will be capable of discharging the developer 10 inside the preset case 11 into the developer container 1. On the other hand, in a construction in which the region 20 like the one as shown in FIG. 4B is not provided, the inner wall above the toner sensor detecting position as seen in the longitudinal direction of the developer container 1 will not be opened relative to the preset case 11. Therefore, the developer 10 falling by gravity into the developer container 1 will be left on the hold-down wall 9 and will not enter the developer container 1.

Figure 5A:
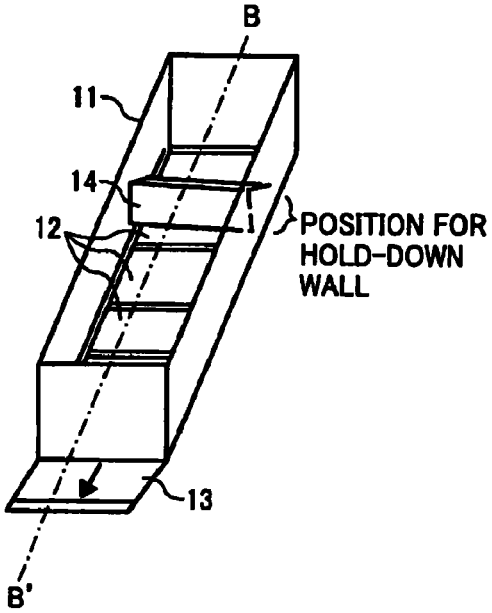
FIG. 5A is a perspective view of a preset case and FIG. 5B is a cross-sectional view taken along the line B-B' in FIG. 5A.
Figure 5B:
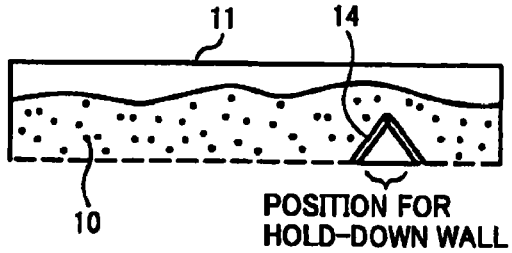
Figure 6A:
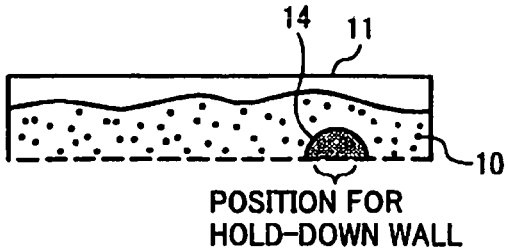
FIGS. 6A-6C are longitudinal cross-sectional views of a preset case according to the invention.
Figure 6B:
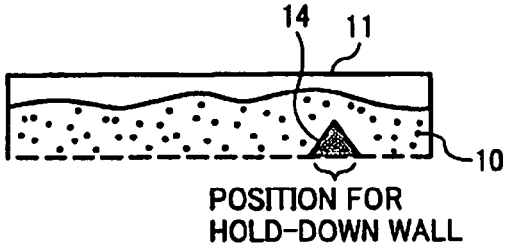
Figure 6C:
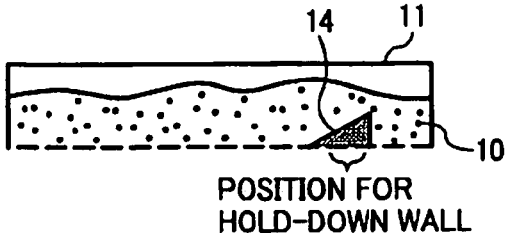

Therefore, according to the invention, it is so arranged that the developer 10 stands clear of the hold-down wall 9 to thereby fall into the developer container 1. In other words, as shown in FIG. 5, regarding the developer 10 which is present above the hold-down wall 9 of the second developer-mixing region 5, there is disposed a guide member 14 so that the developer 10 may fall onto the both (back and forth) side portions of the hold-down wall 9 in the second developer-mixing region 5.

The guide member 14 is formed into a shape so that the developer 10 inside the preset case 11 is fed uniformly over the second developer-mixing region 5 except for the position corresponding to the hold-down wall 9, without the possibility that the developer 19 inside the preset case 11 is left as it is in the present case 11. In other words, the shape will be acceptable if it is such that the developer 10 will not stay on the upper surface or side surface of the guide member 14, but will be charged into the second developer-mixing region 5. For example, as shown in FIGS. 5B, 6A-6C, the shape may be triangular, and/or projected toward the preset case (i.e., triangular or elliptical shape). The guide member 14 may be arbitrarily provided depending on the position at which the hold-down wall 9 is provided.

As described above, by providing the guide member 14, the developer 10 can be fed or supplied uniformly over the portions other than (except for) the hold-down wall 9 in a construction simpler than the construction as shown in FIGS. 4A, 4B. Therefore, a uniform feeding of the developer 10 into the developer container 1 can be made at the initial operation more quickly and more accurately. In addition, there is no need of providing the region 20 as shown in FIG. 4B.

Figure 7:
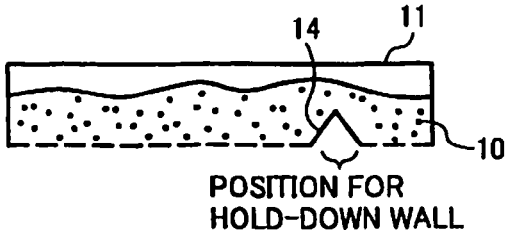
FIG. 7 is a longitudinal cross-sectional view of a preset case according to the invention.

Furthermore, as shown in FIG. 7, by integrally forming the guide member 14 with the preset case 11, the number of parts can be reduced. As a result, the handling of the parts becomes easy and the cost can be reduced. The shape of the guide member 14 in the example of an integral forming as shown in FIG. 7 is only an example; the guide member 14 may be of other shapes like those shown in FIG. 5A and others.

Figure 8:
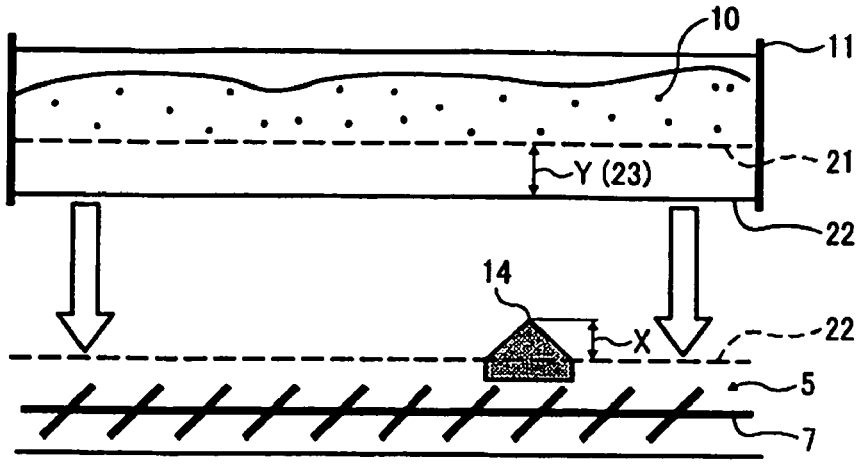
FIG. 8 is a cross-sectional view of a preset case and a developer container (second developer-mixing region side)
Figure 9:
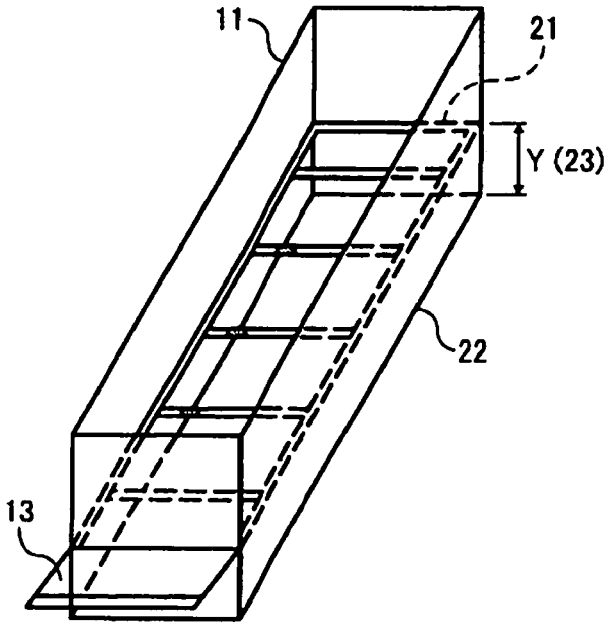
FIG. 9 is a perspective view of the preset case shown in FIG. 8.

In addition, as shown in FIGS. 8 and 9, the guide member 14 may be disposed not on the preset case 11 but on the developer container 1 on which the preset case 11 is disposed.

FIG. 8 is a sectional view (on the side of the second developer-mixing region 5) of the reset case 11 and the developer container 1. FIG. 9 is a perspective view of the preset case shown in FIG. 8. At the bottom of the guide member 14, there is provided a hold-down wall 9 (not illustrated). This preset case 11 provides an extension wall 23 which extends from the surface 21 of disposing the preset seal to the surface 22 of disposing in which the preset case 11 and the developer container 1 come into contact with each other. The surface 22 of disposing on the side of the developer container 1 is provided with the guide member 14.

Here, mark "X" in FIG. 8 shows a height of the guide member 14 from the surface 22 on which the guide member is disposed. Mark "Y" in FIG. 9 shows a height from the surface 22 of disposing on the side of the preset case to the surface 21 of disposing the preset seal (i.e., the height of the extension wall 23 of the reset case). The guide member 14 and the surface 21 of disposing the preset seal may be of a positional relationship in which the two do not interfere with each other, i.e., $X \leqq Y$.

In this case, the shape of the guide member 14 may be projected upward as noted above (i.e., triangular or elliptic shape) and is not limited to the illustrated shapes. In the same manner as in the above case, the surface of disposing the guide member 14 and the surface of disposing the developer container 1 may be integrally formed.

In addition, instead of providing the preset case 11 with the extension wall 23, there may be provided an extension wall on the side of the developer container 1. Or else, both the preset case 11 and the developer container 1 may be provided with an extension wall, respectively, so that the guide member 14 may be disposed within the height of the extension wall.

By employing the above-described arrangement, like in the arrangement in which the preset case 11 is provided with the guide member 14, the developer 10 can be uniformly charged or fed, in a simple construction, to the other portions except for the hold-down wall 9 in the initial feeding (or initial fill).

The development apparatus according to the invention is made up of a combination of the developer container 1 as shown in FIGS. 1-3 and the preset case 11 as shown in FIGS. 4-9. The development apparatus of the invention may be constituted as a process cartridge 15 which is removably attached to the image forming apparatus main body in a manner integral with an image carrying body (photoreceptor 31) and electrostatic charging means (electrostatic charging member 32). Handling of the process cartridge can be made easier according to this arrangement.

The development apparatus of the invention is applicable to an image forming apparatus. Description will now be made of an embodiment of an electrophotographic copying machine as an example of an image forming apparatus.

Figure 10:
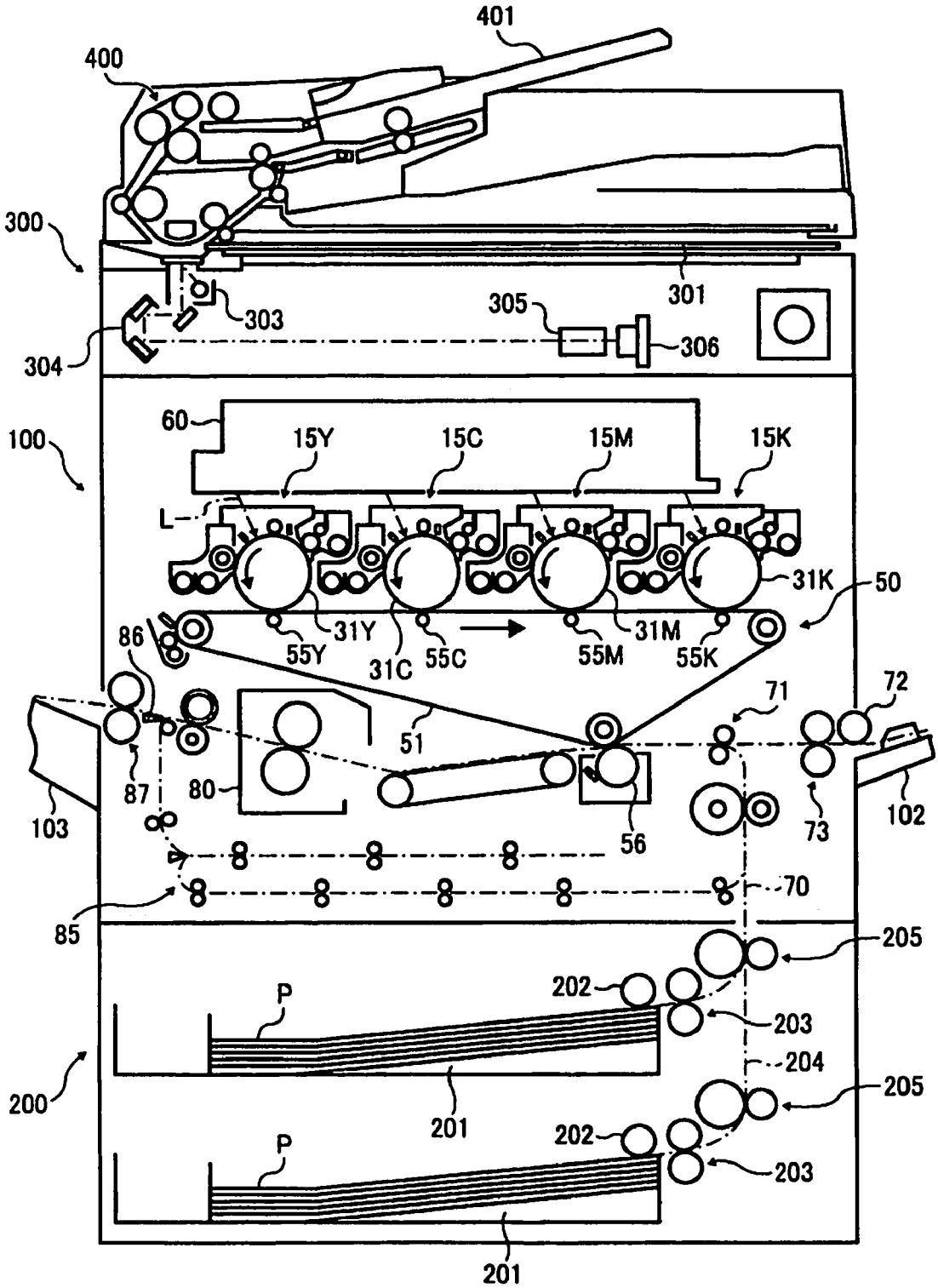
FIG. 10 is a schematic view of an image forming apparatus according to the invention.

FIG. 10 is a schematic arrangement drawing showing a copying machine relating to the invention. The copying machine is made up of a printer unit 100 for forming an image on a piece of recording paper; a paper feed device 200 for feeding the printer unit 100 with pieces of recording paper P; a scanner 300 for reading an image on an original copy; an automatic document feeding apparatus (also referred to as ADF) 400 for automatically feeding the scanner 300 with original copies; and the like.

In the scanner 300 a first traveling body 303 having mounted thereon a light source for illuminating the original copy, a mirror, and the like, and a second traveling body 304 having mounted thereon a plurality of reflecting mirrors move back and forth to thereby scan and read off the original copy (not illustrated) placed on a contact glass 301. The scanning light to be sent out of the second traveling body 304 is gathered by a tube lens 305 on an image-forming surface of a reading sensor 306 disposed behind the tube lens 305, and is thereafter read by the reading sensor 306 as an image signal.

The side surface of the casing of the printer unit 100 is provided with: a manual feed tray 102 into which the pieces of recording paper P to be fed inside the printer casing are manually placed in position; and a paper feed tray 103 into which pieces of recording paper P having formed thereon images and delivered out of the printer casing are held in stack.

Figure 11:
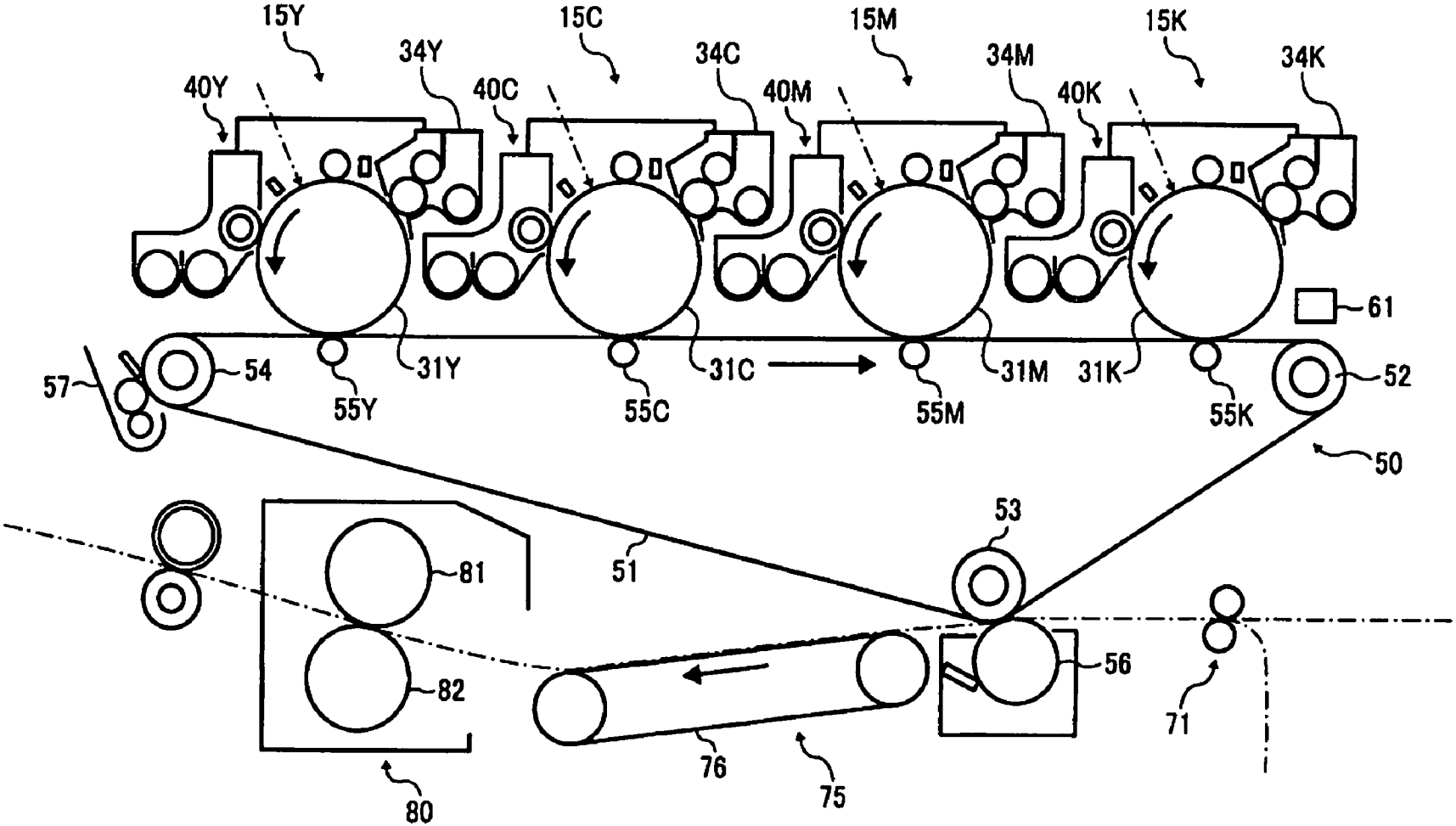
FIG. 11 is a schematic view of the image forming apparatus shown in FIG. 10 of the invention.

FIG. 11 is a partially enlarged schematic view showing an inner arrangement of a part of the printer unit 100. The printer unit 100 has disposed inside the casing thereof a transfer unit 50, as a transfer means, which has in an extended manner an endless intermediate transfer belt 51, as a transfer body, by means of a plurality of rollers. The intermediate transfer belt 51 is made of polyimide fibers which are small in elongation, the polyimide fibers being dispersed with carbon powder for adjusting the electric resistance. The intermediate transfer belt 51 is driven clockwise as seen in the figure in an endless manner while being supported and extended by a driving roller 52 which is rotated clockwise as seen in the figure by a driving means (not illustrated), a secondary transfer backup roller 53, a driven roller 54, and four primary transfer rollers 55Y, 55C, 55M, 55K. The alphabetical letters Y, C, M, K affixed to the end of each of the primary transfer rollers signify the color of the material to be used therein, i.e., yellow, cyan, magenta, and black. Hereinafter, the same applies to the alphabetical letters added to the end of each reference mark.

The intermediate transfer belt 51 is extended while taking a large turn respectively at the driving roller 52, the secondary transfer backup roller 53, and the driven roller 54, thereby forming an inverted triangle with the bottom side of the triangle facing upward. The upper extension part of the belt which corresponds to the bottom side of the inverted triangle extends in the horizontal direction. On top of the upper extension part of the belt, as illustrated in FIG. 10, there are disposed four process cartridges 15Y, 15C, 15M, 15K side by side in the horizontal direction.

As shown in FIG. 10 there is disposed an optical writing unit 60 above the four process cartridges 15Y, 15C, 15M, 15K. Based on the image information of the original copy as read out by the scanner 300, the optical writing unit 60 exits four writing lights L by driving four semiconductor lasers by laser drive unit (not illustrated). Then, the dark drum-shaped photoreceptors 31Y, 31C, 31M, 31K, as the latent image carrying members, of the process cartridges 15Y, 15C, 15M, 15K, respectively, are scanned in the dark by the writing lights L, to thereby write the static latent image for Y, C, M, K on the surface of the photoreceptors 31Y, 31C, 31M, 31K.

The optical writing unit 60 in this embodiment has the arrangement in which the laser light irradiated from a semiconductor laser is deflected by a polygon mirror (not illustrated), reflected by a reflection mirror (not illustrated), and cause the laser light to pass through an optical lens, to thereby perform optical scanning. As a substitute for the above arrangement, there may be used an arrangement in which optical scanning is performed by an LED array.

Figure 12:
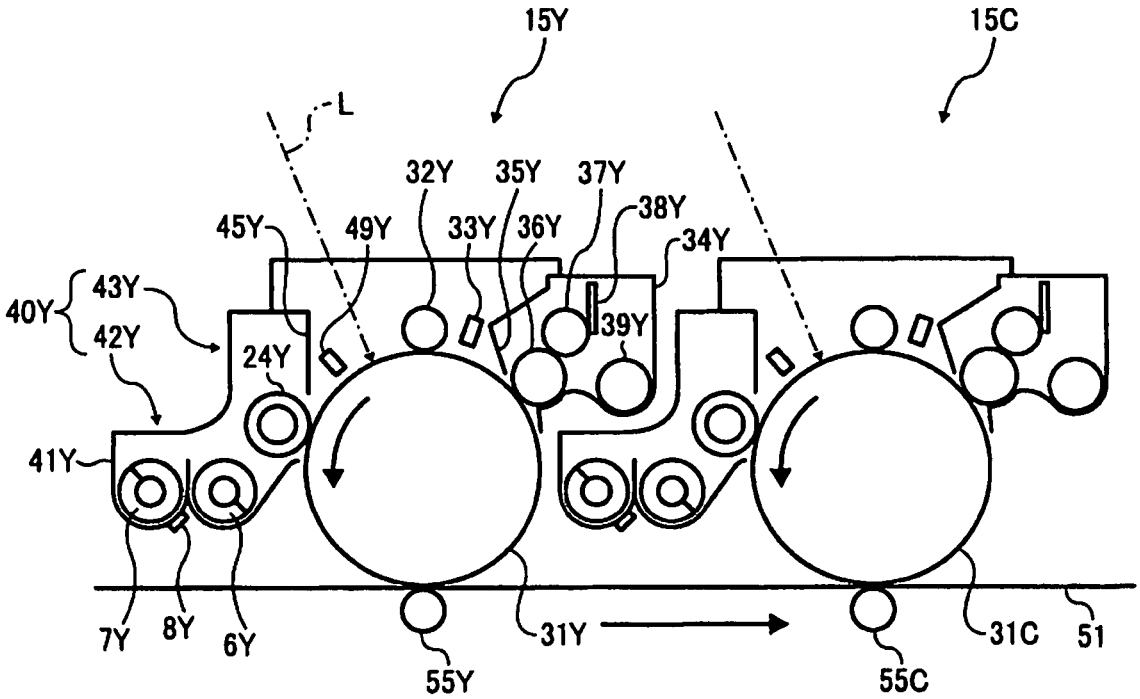
FIG. 12 is an enlarged arrangement view around a process cartridge in a printer unit shown in FIG. 11.

FIG. 12 is an enlarged schematic view showing an arrangement of the process cartridges 15Y, 15C for colors Y and C illustrated together with the intermediate transfer belt 51. The process cartridge 15Y for the color Y has, around the drum-shaped photoreceptor 31Y, an electrostatic charging member 32Y as electrostatic charging means, an antistatic eliminator 33Y, a drum cleaning apparatus 34Y, a development apparatus 40Y as developing means, an electric potential sensor 49, and the like. They are held together by a casing which is a common supporting member so that they can be attached to, or detached from, the printer unit 100 integrally as a single unit.

The electrostatic charging member 32Y is a roller-shaped member which is rotatably supported by a bearing (not illustrated) while being in contact with the photoreceptor 31Y. The electrostatic charging member 32Y rotates in contact with the photoreceptor 31Y while being charged with electrostatic charging bias by a bias supply means (not illustrated). As a result, the surface of the photoreceptor 31Y is uniformly electrostatically charged into the same polarity as the electrostatic charging polarity of, e.g., the Y toner. Instead of this kind of electrostatic charging member 32Y, there may be employed scorotron charger which performs uniform electrostatic charging to the photoreceptor 31Y in a non-contact manner.

The development apparatus 40Y which contains in the casing 41Y a developer of Y color containing therein a magnetic carrier and a non-magnetic toner (both not illustrated), has a developer transporting unit 42Y and a developing section 43Y. In the developing section 43Y, the developing sleeve 44Y as the developer carrying member which moves endlessly along the surface by being driven to rotate by a driving means (not illustrated), keeps a part of the peripheral surface exposed to the outside through an opening provided in the casing 41Y. As a result, there is formed a developing region in which the photoreceptor 31Y and the developing sleeve 44Y lie opposite to each other at a given distance therebetween.

Inside the developing sleeve 44Y which is made of a non-magnetic hollow pipe member, there are fixed to the developing sleeve 44Y in a manner not to be caused to rotate, a plurality of magnet rollers (not illustrated) having a plurality of magnetic poles arranged in the peripheral direction. The developing sleeve 44Y is driven to rotate while causing the Y developer inside the developer transporting unit 42Y (to be described in detail hereinafter) to be adsorbed on the surface of the developing sleeve 44Y by means of the magnetic force to be emitted by the magnet roller. In this manner, the developing sleeve 44Y sucks the Y developer from the developer transporting unit 42Y. The Y developer that is transported to the developing region as a result of rotation of the developing sleeve 44Y enters a doctor gap of 0.9 mm which is formed between a doctor blade 45Y and the sleeve surface, the doctor blade being disposed such that the front edge thereof lies opposite to the surface of the developing sleeve 44Y at a given clearance. The thickness of the layer on the sleeve is thus restricted to 0.9 mm or less. When the Y developer is transported to the neighborhood of the developing region which lies opposite to the photoreceptor 31Y as a result of rotation of the developing sleeve 44Y, the Y developer forms a brush of carrier on the sleeve by receiving magnetic forces of the developing magnetic poles (not illustrated) of the above-described magnet rollers, thereby forming a strand of the magnetic brush.

The developing sleeve 44Y is charged by a bias supply means (not illustrated) with developing bias of the same polarity as, e.g., the charging polarity of the toner. According to this arrangement, in the developing region, there will operate non-developing potential which electrostatically moves the Y toner from the non-image side to the sleeve side between the surface of the developing sleeve 44Y and the non-imaging portion (i.e., uniformly charged portion=bare surface portion). Further, between the surface of the developing sleeve 44Y and the electrostatic latent image on the photoreceptor 31Y, there will operate the developing potential which electrostatically moves the Y toner from the sleeve side to the electrostatic latent image. As a result of operation of the developing potential, the Y toner in the Y developer will be transferred to the electrostatic latent image, whereby the electrostatic latent image on the photoreceptor 31Y will be developed to the Y toner image.

As a result of rotation of the developing sleeve 44Y, the Y developer that has passed through the above-described developing region will leave the developing sleeve 44Y to thereby return to the developer transporting unit 42Y under the influence of the repellant magnetic force to be formed by the repellant magnetic rollers which are provided in the magnet rollers (not illustrated).

The developer transporting unit 42Y is made up of: a second transporting screw 7Y and a first transporting screw 6Y, two screws in total; a partition wall 16 interposed between the two screws; a toner concentration detection sensor 8Y made up of a magnetic permeability sensor; and the like. The partition wall 16 partitions the second developer-mixing region 5 in which the second transporting screw 7Y is housed from the first developer-mixing region 4 in which the first transporting screw 6Y is housed. In the regions which lie opposite to both axial end portions of both the screws, both the transporting chambers are communicated with each other respectively through an opening (not illustrated).

Each of the first transporting screw 6Y and the second transporting screw 7Y as the mixing transporting member has a rotating axis member rotatably supported by bearings (not illustrated) at both ends, and a helical blade provided in a projecting manner about the periphery of the axis member. As a result of rotation by rotating means (not illustrated), the Y developer is transported in the direction of axis of rotation.

In the second developer-mixing region 5 in which the second transporting screw 7Y is housed, the developer Y is transported as a result of rotation of the second transporting screw 7Y from this side as seen in the direction perpendicular to the drawing sheet to the direction away from this side (i.e., the other side). When transported to the neighborhood of the end portion on the other side, the Y developer enters the first developer-mixing region 4 through an opening (not illustrated) provided in the partition wall 16.

Above the first developer-mixing region 4 in which the first transporting screw 6Y is housed, there is formed the above-described developing section 43Y. The first developer-mixing region 4 and the developing section 43Y are in communication with each other in the entire region in which they face each other. According to this arrangement, the first transporting screw 6Y and the developing sleeve 44Y disposed at a slanting upper part lie opposite to each other while keeping a parallel relationship with each other. In the first developer-mixing region 4 the developer Y is transported, as a result of rotation of the first transporting screw 6Y, from the other side as seen in the direction perpendicular to the drawing sheet toward this side. In the process of this transportation the developer Y in the periphery of rotation of the first transporting screw 6Y is appropriately scooped up into the developer sleeve 44Y, or the developer Y, after developing processing, from the developing sleeve 44Y is appropriately recovered. Then, the developer Y that has been transported near the end, on this side as seen in the drawing sheet, of the first developer-mixing region 4 returns to the second developer-mixing region 5 through an opening (not illustrated) which is provided in the partition wall 16.

In the lower wall of the second developer-mixing region 5 there is fixed a toner concentration detection sensor 8Y as a toner concentration detection means which is made up of a magnetic permeability sensor. The concentration of the toner being transported by the second transporting screw 7Y is detected from a lower side to thereby output voltage corresponding to the result of detection. A control unit (not illustrated) drives a Y toner feed unit (not illustrated) based on the output voltage value from the toner concentration detecting sensor 8Y, and an adequate amount of Y toner is supplied to the second developer-mixing region 5. As a result, the toner concentration, once lowered accompanied by development processing, will be recovered.

The Y toner image formed on the photoreceptor 31Y is primarily transferred to the intermediate transfer belt 51 by a primary transfer nip (to be described hereinafter) for the color yellow Y. On the surface of the photoreceptor 31Y that has passed through the primary transfer process, there is adhered toner that has not been primarily transferred to the intermediate transfer belt 51.

The drum cleaning unit 34Y holds, in a cantilevered manner, a cleaning blade 35Y which is made, e.g., of polyurethane rubber, and the like. The free end of the cleaning blade 35Y is brought into contact with the surface of the photoreceptor 31Y. In addition, a rotary shaft member to be driven for rotation by a driving means (not illustrated) and a front end of a brush roller 36Y provided with a multiplicity of electroconductive raisings that are vertically disposed on the circumference of the rotary shaft are kept in contact with the photoreceptor 31Y. The above-described residual toner remaining on the photoreceptor 31Y is scraped off or swept off from the surface of the photoreceptor 31Y with the cleaning blade 35Y and the brush roller 36Y. The brush roller 36Y is charged with a cleaning bias through an electric field roller 37Y of metallic make, the electric field roller 37Y being in contact with the brush roller 36Y. The front end of a scraper 38Y is urged against the electric field roller 37Y. The residual toner remaining on the photoreceptor after transfer is scraped off or swept off from the photoreceptor 31Y by the cleaning blade 35Y. The brush roller 36Y passes through the brush roller 36Y and the electric field roller 37Y and, thereafter, is scraped off from the electric field roller 37Y by the scraper 38Y, thereby falling on a recovery screw 39Y. Thereafter, after being delivered to the outside of the casing accompanied by the driving for rotation of the recovery screw 39Y, the toner is returned to the developer transporting unit 42Y through a toner recycling transporting means (not illustrated).

The surface of the photoreceptor 31Y from which the residual toner remaining after transfer has been cleaned by a drum cleaning unit 34Y is statically eliminated by an antistatic eliminator 33Y which is made up of a statically eliminating lamp and the like, and is thereafter uniformly electrostatically charged.

Electric potential of the non-image portion of the photoreceptor 31Y that has passed through the position of optical writing by writing light L is detected by the electric potential sensor 49Y. The result of the detection is sent to a control unit (not illustrated).

The photoreceptor 31Y of 60 mm in diameter is driven for rotation at a linear speed of 282 mm/sec. The developing sleeve 34Y of 25 mm in diameter is driven for rotation at a linear speed of 564 mm/sec. The amount of electrostatic charge in the toner to be supplied to the developing region is in the range of about −10 through −3 μC/g. The developing gap which is the clearance between the photoreceptor 31Y and the developing sleeve 44Y is set to be in the range of 0.5 through 0.3 mm. The thickness of the photosensitive layer of the photoreceptor 31Y is 30 μm. The beam spot diameter on the photoreceptor 31Y of the writing light L is 50×60 μm, and the light quantity thereof is about 0.47 mW. The uniformly electrostatically-charged potential of the photoreceptor 31Y is, e.g., −700V and the electric potential of the electrostatic latent image is −120V. The developing bias voltage is, e.g., −470V, thereby securing a developing potential of 350 V.

Description was made in detail of the process cartridge for color Y. The process cartridges for other colors (15C, 15M, 15K) are the same as the process cartridge 15Y except for the fact that the color of the toner is different.

In FIG. 11 the photoreceptors 31Y, 31C, 31M, 31K for the process cartridges 15Y, 15C, 15M, 15K are rotated in contact with the upper extended surface of the intermediate transfer belt 51 which endlessly travels in the clockwise direction, thereby forming primary transfer nips for colors Y, C, M, K. On the reverse side of these primary transfer nips for colors Y, C, M, K, the above-described primary transfer rollers 55Y, 55C, 55M, 55K are in contact with the reverse surface of the intermediate transfer belt 51. Then, these primary transfer rollers 55Y, 55C, 55M, 55K are charged by bias feed means (not illustrated) with the primary transfer bias which is opposite in polarity to the charging polarity of the toner. Due to this primary transfer bias, the primary transfer nips for colors Y, C, M, K are formed with the primary transfer electric field for electrostatically transferring the toner from the photoreceptor to the belt. The toner images of colors Y, C, M, K formed on the photoreceptors 31Y, 31C, 31M, 31K enter the primary transfer nips as a result of rotation of the photoreceptors 11Y, 11C, 11M, 11K. Then, under the operation of the primary transfer electric field and the nip pressure, the above-described toner images are primarily transferred in sequence onto the intermediate transfer belt 51. As a result, on the right face (i.e., loop outer peripheral surface) of the intermediate transfer belt 51, the toner image having overlapped the four colors together (hereinafter referred to as four-color toner image) will be formed. In place of the primary transfer rollers 55Y, 55C, 55M, 55K, an electro-conductive brush to which the primary transfer bias is charged, or a non-contact type of corona charger may be employed.

Figure 13:
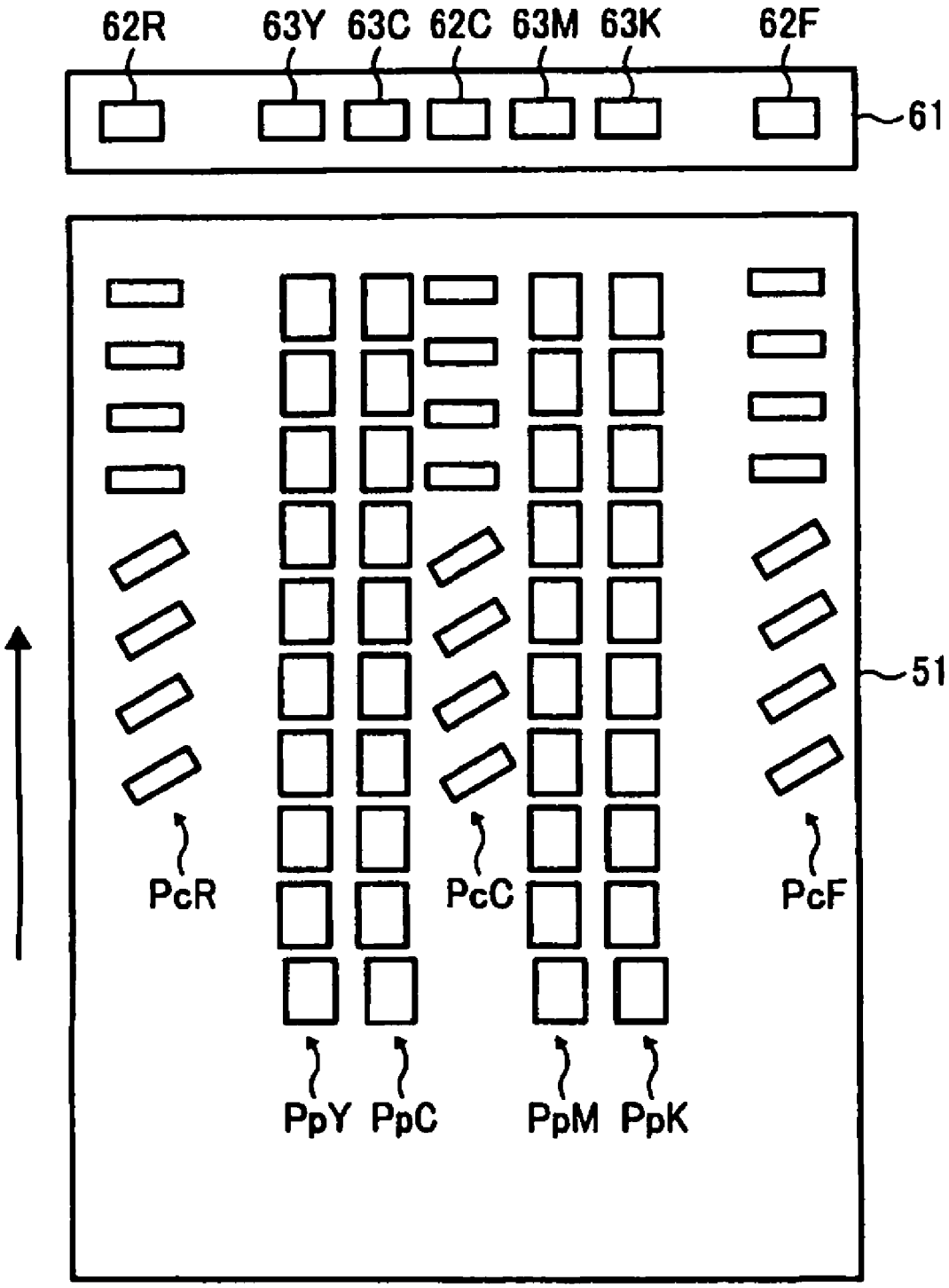
FIG. 13 is a plan view of an optical sensor unit and an intermediate transfer belt in the printer unit shown in FIG. 11.

To the right, as seen in the figure, of the process cartridge 15K for color K, there is disposed an optical sensor unit 61 in a manner to lie opposite to the right face of the intermediate transfer belt 51 at a given clearance. As shown in FIG. 13, this optical sensor unit 61 has a rear-side position detection sensor 62R, a Y-image density detection sensor 63Y, a C-image density detection sensor 63C, a center-position detection sensor 62C, an M-image density detection sensor 63M, a K-image density detection sensor 63K, and a front-side position detection sensor 62F, all of which lie in widthwise direction of the intermediate transfer belt 51. These sensors are made of reflection type of photo-sensors. They reflect the light issued from a light emitting element (not illustrated) out of the right (or front) face of the intermediate transfer belt 51 or from the toner image on the belt, and the amount of the reflected light is detected by a light-receiving element (not illustrated). The control unit (not illustrated) detects the toner image on the intermediate transfer belt 51 or detects the image density (the amount of toner adhesion per unit area) based on the output voltage from these sensors.

As shown in FIG. 11, the secondary transfer roller 56 is disposed below the intermediate transfer belt 51. The secondary transfer roller 56 comes into contact with the front face of the intermediate transfer belt while it is being driven by a driving means (not illustrated) so as to be rotated in the counterclockwise direction, thereby forming a secondary transfer nip. On the rear side of this secondary nip, a secondary transfer backup roller 53 that is electrically grounded is arranged to run over the intermediate transfer belt 51.

The secondary transfer roller 56 is charged with a secondary transfer bias which is opposite in polarity to the charging polarity of the toner, the charging being made by a bias supply means (not illustrated). As a result, the secondary transfer electric field is formed between the secondary roller 56 and the grounded secondary transfer backup roller 53. The four-color toner image formed on the front face of the intermediate transfer belt 51 enters the secondary transfer nip as a result of endless traveling of the intermediate transfer belt 51.

In FIG. 10 as earlier illustrated, the paper feed unit 200 is respectively provided with a plurality of the following: i.e., paper feed cassettes 201 which store therein the recording paper P; paper feed rollers 202 which feed (or pay) the recording paper P out of the cassettes 201; separating roller pairs 203 which separate the paid out recording paper P one by one; transporting roller pairs 205 which transport the separated recording paper P along a payout passage 204; and the like. The paper feed unit 200 is disposed right below the printer unit 100 as illustrated. The payout passage 204 of the paper feed unit 200 is connected to a paper feed passage 70 of the printer unit 100. According to this arrangement, the printer paper P paid out of the paper feed cassettes 201 of the paper feed unit 200 is fed into the paper feed passage 70 of the printer unit 100 through the payout passage 204.

Near the end of the paper feed passage 70 of the printer unit 100, there is disposed a resist roller pair 71, in which a recording paper P pinched by the roller is fed into the secondary transfer nip at a timing of being capable of synchronizing with the four-color toner image on the intermediate transfer belt 51. In the secondary transfer nip, the four-color toner image on the intermediate transfer belt 51 is transferred in a lump to the recording paper P under the influence of the secondary transfer electric field or the nip pressure. Together with the white color of the recording paper P, the image becomes a full-color image. In this manner, the recording paper P on which the full-color image has been formed is delivered from the secondary transfer nip and is separated from the intermediate transfer belt 51.

To the left of the secondary transfer nip as seen in the figure, there is disposed a transfer belt unit 75 which drives a paper transfer endless belt 76, while extending among a plurality of extension rollers, in the counterclockwise direction as seen in the figure. The recording paper P that has been separated from the intermediate transfer belt 51 is handed over to the upper extended surface of the paper transfer belt 76 for further transferring to a fixing unit 80.

The recording paper P that has been sent to the fixing unit 80 is pinched into a fixing nip made up of a heating roller 81 which includes a heat-generating source such as a halogen lamp and the like (not illustrated), and a pressing roller 82 which is urged toward the heating roller 81. While the full-color image is being fixed to the surface under pressure and heat, the recording paper P is sent out of the fixing unit 80.

The surface of the intermediate transfer belt 51 that has passed through the secondary transfer nip has adhered thereto a small amount of residual secondary transfer toner that has not been transferred to the recording paper P. The residual secondary transfer toner is removed by a belt cleaning unit 57 which is in contact with the front surface of the intermediate transfer belt 51.

In FIG. 10 as illustrated earlier, there is disposed a switch back unit 85 below the fixing unit 80. When the recording paper P delivered from the fixing unit 80 reaches a transfer passage switching position by a swingable change-over claw 86, the recording paper P is sent to the paper discharge roller pair 87 or to the switch back unit 85 depending on the stop position after swinging of the changeover claw 86. In case the recording paper P is sent to the paper discharge roller pair 87, the paper is delivered out of the apparatus and is kept in stock on the paper discharge tray 103.

On the other hand, in case the recording paper P is sent to the switch back unit 85, it is turned upside down by the switch back transporting by the switch back unit 85 and is transported again to the resist roller pair 71. Then, the recording paper P enters the secondary transfer nip once again for forming a full-color image on the remaining surface.

The recording paper P that has been manually fed into the manual feed tray 102 provided on one side of the casing of the printer unit 100 is sent to the resist roller pair 71 after passing through a manual feed roller 72 and a manual feed separation roller pair 73. The resist roller pair 71 may be grounded or charged with bias to remove the paper dust of the recording paper P.

When a copy is made of an original copy with the copying machine according to the invention, first, the original copy is set in position on the document receiver 301 of the automatic document feeding apparatus 400. Or else, the cover of the automatic document feeding apparatus 400 is tilted to set in position the original copy on the contact glass 301 of a scanner 300. The cover of the automatic document feeding apparatus 400 is closed and the cover is held downward. Thereafter, when a switch (not illustrated) is pushed, the original copy is fed into the contact glass 301 in case the original copy was set in position in the automatic document feeding apparatus 400. Then, the scanner 300 is driven, so that the read-scanning is started by the first running body 303 and the second running body 304. At substantially the same time, the driving is started of the transfer unit 50 and the process cartridges of the respective colors 15Y, 15C, 15M, 15K. Furthermore, paying out of the recording paper P from the paper feed unit 200 is also started. In case the recording paper P that is not set in position in the paper feed cassette 201 is used, the recording paper P set in position in the manual feed tray 102 is fed out.

As described hereinabove, preferably the preset case further comprises a guide member provided on an inner wall of a bottom side of the developer container at a position corresponding to the hold-down wall, the guide member being shaped to project toward the preset case.

According to an embodiment of the invention, preferably, the development apparatus further comprises a toner concentration detector that detects a concentration of the toner to be transported inside the developer container. The cover member is a hold-down wall that holds down the toner in a gravitationally downward direction by coming into contact with the toner from a gravitationally upper side, the toner moving upward from the gravitationally lower side as a result of rotation of the mixing transportation member. The hold-down wall is disposed, out of an entire region in the direction of developer transportation at the developer transportation unit, in a region: in which a bottom wall of the developer transportation unit lies opposite to the gravitationally lower side of the mixing transportation member; in which side walls of the developer transportation unit lie opposite to each other on both sides that cross at right angles to an axis of rotation of the mixing transportation member; and in which the toner concentration of the developer under transportation is detected by the toner concentration detector.

According to the above-described arrangement, although the bottom surface of the preset case constitutes the developer feed port, the developer feed port is formed in a position except for the hold-down wall of the developer container. Therefore, the developer is prevented from getting accumulated on the hold-down wall, whereby it is possible to feed the developer inside the preset case into the developer container.

Preferably, the development apparatus further comprises a guide member provided on an inner wall of a bottom side of the developer container at a position corresponding to the hold-down wall, the guide member being shaped to project toward the preset case.

According to an embodiment of the invention, in the development apparatus, the guide member is preferably formed integrally with the preset case.

In the development apparatus, preferably an upper part of the hold-down wall is mountain-shaped or shaped to project toward the preset case.

According to the above-described arrangement, the developer to be fed from the preset case can be arranged to fall into the developer-mixing region at the front and rear of the position corresponding to the hold-down wall, as seen in the longitudinal direction. In this manner, by a simple construction, the toner can be fed to the portion except for the portion of the hold-down wall. The uniform feeding or charging of the toner at the initial operation can be made more quickly and more accurately.

According to the above-described arrangement, the number of constituent parts can further be reduced, resulting in an easier handling and cost reduction.

In the development apparatus, preferably, the sealing member is disposed from a surface in which the preset case and the developer container are disposed to a position above the height of an upper part of the hold-down wall, wherein an extension wall is provided in at least one of the preset case and the developer container.

Preferably, the process cartridge comprises an image carrying member, an electrostatic charging device, and the development apparatus, all being constituted integrally and detachable to and from the image forming apparatus.

According to the above-described arrangement, there can be provided a process cartridge which is superior in the ease with which the process cartridge can be handled in attaching to, and detaching from, the image forming apparatus.

Although the invention has been fully described in connection with the preferred embodiments thereof with reference to the accompanying drawings, it is to be noted that various changes and modifications are apparent to those skilled in the art. Accordingly, the preferred embodiments of the invention as set forth above are intended to be illustrative only, not limiting. Various changes to the invention may be made without departing from its true spirit and scope as defined in the following claims.

What is claimed is:

1. A preset case for keeping therein unused initial fill of developer, the preset case being disposed on top of a developer transportation unit of a developing apparatus, the developing apparatus comprising:

a developer container having the developer transportation unit that transports, while mixing, a developer containing a toner and a carrier along an axis of rotation by a rotatable mixing transportation member; and a cover member provided, out of an entire region as seen in a direction of transportation of the developer, in part of the developer transportation unit so as to cover an upper portion of the mixing transportation member, the preset case comprising:

a developer feed port provided on that bottom surface of the preset case which lies on a side of the developer container;

a sealing member that seals the developer feed port, the sealing member being mounted so as to be removable, when putting the preset case to use, in a longitudinal direction of the mixing transportation member, wherein the developer feed port is provided except for a position that lies opposite to the cover member disposed in the developer transportation unit.

2. A preset case for keeping therein unused initial fill of developer, the preset case being disposed on top of a developing apparatus, the developing apparatus comprising:

a developer container including a developer transportation unit that transports, while mixing, a developer containing a toner and a carrier along an axis of rotation by a rotatable mixing transportation member, and a toner concentration detection unit that detects a concentration of the toner to be transported inside the developer transportation unit; and a hold-down wall that holds down the toner in a gravitationally downward direction by coming into contact with the toner from a gravitationally upper side, the toner moving upward from a gravitationally lower side as a result of rotation of the mixing transportation member, the hold-down wall being disposed in a region, out of an entire region in the direction of developer transportation at the developer transportation unit, in which a bottom wall of the developer transportation unit lies opposite to the gravitationally lower side of the mixing transportation member and in which side walls of the developer transportation unit lie opposite to each other on both sides that cross at right angles to an axis of rotation of the mixing transportation member, the preset case comprising:

a developer feed port provided on that bottom surface of the preset case which lies on a side of the developer container;

a sealing member that seals the developer feed port, the sealing member being mounted so as to be removable, when putting the preset case to use, in a longitudinal direction of the mixing transportation member, wherein the developer feed port is provided except for a position that lies opposite to the cover member disposed in the developer transportation unit.

3. The preset case according to claim 2, further comprising a guide member provided on an inner wall of a bottom side of the developer container at a position corresponding to the hold-down wall, the guide member being shaped to project toward the preset case.

4. The preset case according to claim 3, wherein the guide member is formed integrally with the preset case.

5. A development apparatus comprising:

a developer container having a developer transportation unit that transports, while mixing, a developer containing a toner and a carrier along an axis of rotation by a rotatable mixing transportation member;

a cover member provided, out of an entire region as seen in a direction of transportation of the developer, in part of the developer transportation unit so as to cover an upper portion of the mixing transportation member; and a preset case that keeps therein unused initial fill of developer, the preset case being disposed on top of the developer transportation unit, the preset case comprising: a developer feed port provided at a bottom surface thereof on a side of the developer container; a sealing member for sealing the developer feed port, the sealing member being mounted so as to be removable, when putting the preset case to use, in a longitudinal direction of the mixing transportation member, the developer feed port being provided except for a position that lies opposite to the cover member disposed in the developer transportation unit.

6. The development apparatus according to claim 5, further comprising a toner concentration detector that detects a concentration of the toner to be transported inside the developer container, wherein the cover member is a hold-down wall that holds down the toner in a gravitationally downward direction by coming into contact with the toner from a gravitationally upper side, the toner moving upward from the gravitationally lower side as a result of rotation of the mixing transportation member, the hold-down wall being disposed, out of an entire region in the direction of developer transportation at the developer transportation unit, in a region: in which a bottom wall of the developer transportation unit lies opposite to the gravitationally lower side of the mixing transportation member; in which side walls of the developer transportation unit lie opposite to each other on both sides that cross at right angles to an axis of rotation of the mixing transportation member; and in which the toner concentration of the developer under transportation is detected by the toner concentration detector.

7. The development apparatus according to claim 6, further comprising a guide member provided on an inner wall of a bottom side of the developer container at a position corresponding to the hold-down wall, the guide member being shaped to project toward the preset case.

8. The development apparatus according to claim 7, wherein the guide member is formed integrally with the preset case.

9. The development apparatus according to claim 6, wherein an upper part of the hold-down wall is mountain-shaped or shaped to project toward the preset case.

10. The development apparatus according to claim 9, wherein the sealing member is disposed from a surface in which the preset case and the developer container are disposed to a position above the height of an upper part of the hold-down wall, wherein an extension wall is provided in at least one of the preset case and the developer container.

11. A process cartridge comprising an image carrying member, an electrostatic charging device, and the development apparatus according to claim 5, all being constituted integrally and detachable to and from the image forming apparatus.

12. An image forming apparatus comprising the process cartridge according to claim 11.

* * * * *